US009862583B2

(12) United States Patent
Piccirilli

(10) Patent No.: US 9,862,583 B2
(45) Date of Patent: Jan. 9, 2018

(54) CONTAINER OPENING DEVICE

(71) Applicant: Robert Piccirilli, Aliquippa, PA (US)

(72) Inventor: Robert Piccirilli, Aliquippa, PA (US)

( * ) Notice: Subject to any disclaimer, the term of this patent is extended or adjusted under 35 U.S.C. 154(b) by 293 days.

(21) Appl. No.: 14/640,070

(22) Filed: Mar. 6, 2015

(65) Prior Publication Data

US 2016/0257546 A1 Sep. 8, 2016

(51) Int. Cl.
*B67B 7/44* (2006.01)
*B67B 7/16* (2006.01)

(52) U.S. Cl.
CPC . *B67B 7/44* (2013.01); *B67B 7/16* (2013.01)

(58) Field of Classification Search
CPC ..... B67B 7/16; B67B 7/44
USPC ..... 81/3.09; D8/40, 18
See application file for complete search history.

(56) References Cited

U.S. PATENT DOCUMENTS

D34,096 S * 2/1901 Stephens ..... 81/3.55
1,913,816 A * 6/1933 Osborne ..... B67B 7/14 30/450
D263,198 S 3/1982 Boyd
4,658,455 A * 4/1987 Skillern ..... A47L 13/512 248/211
5,069,090 A 12/1991 Clark
D328,230 S * 7/1992 Jeffrey ..... D8/105
5,222,265 A 6/1993 Hermanson
6,199,452 B1 3/2001 Vinar
6,578,223 B1 6/2003 Link et al.
7,779,729 B2 8/2010 Pella et al.
8,646,361 B2 2/2014 Minnette et al.
8,950,291 B1 * 2/2015 Coleman ..... B67B 7/44 81/3.09
9,016,170 B2 * 4/2015 Nelson ..... B67B 7/44 7/151
2008/0173136 A1 * 7/2008 Kim ..... B67B 7/16 81/3.55

* cited by examiner

*Primary Examiner* — Hadi Shakeri

(57) ABSTRACT

A container opening device facilitates opening of various types of containers including conventional five gallon buckets, various sizes of paint cans, and the like. the device includes a head coupled to a first end of a handle. The head has a pair of spaced flanges. Each of the flanges is coupled to and extending from a base of the head extending between the flanges. Each of the flanges has a planar distal portion positioned in spaced relationship to the base defining a gap therebetween for engaging and prying edges of a cover on a bucket. A first sidewall extends from the handle adjacent to a second end of the handle. The first sidewall has a thickness for insertion into a space between a lid and a top edge of a can to pry the lid away from the can.

1 Claim, 7 Drawing Sheets

CONTAINER OPENING DEVICE

BACKGROUND OF THE DISCLOSURE

Field of the Disclosure

The disclosure relates to opening devices and more particularly pertains to a new opening device for facilitating opening of various types of containers including conventional five gallon buckets, various sizes of paint cans, and the like.

SUMMARY OF THE DISCLOSURE

An embodiment of the disclosure meets the needs presented above by generally comprising a head coupled to a first end of a handle. The head has a pair of spaced flanges. Each of the flanges is coupled to and extending from a base of the head extending between the flanges. Each of the flanges has a planar distal portion positioned in spaced relationship to the base defining a gap therebetween for engaging and prying edges of a cover on a bucket. A first sidewall extends from the handle adjacent to a second end of the handle. The first sidewall has a thickness for insertion into a space between a lid and a top edge of a can to pry the lid away from the can.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
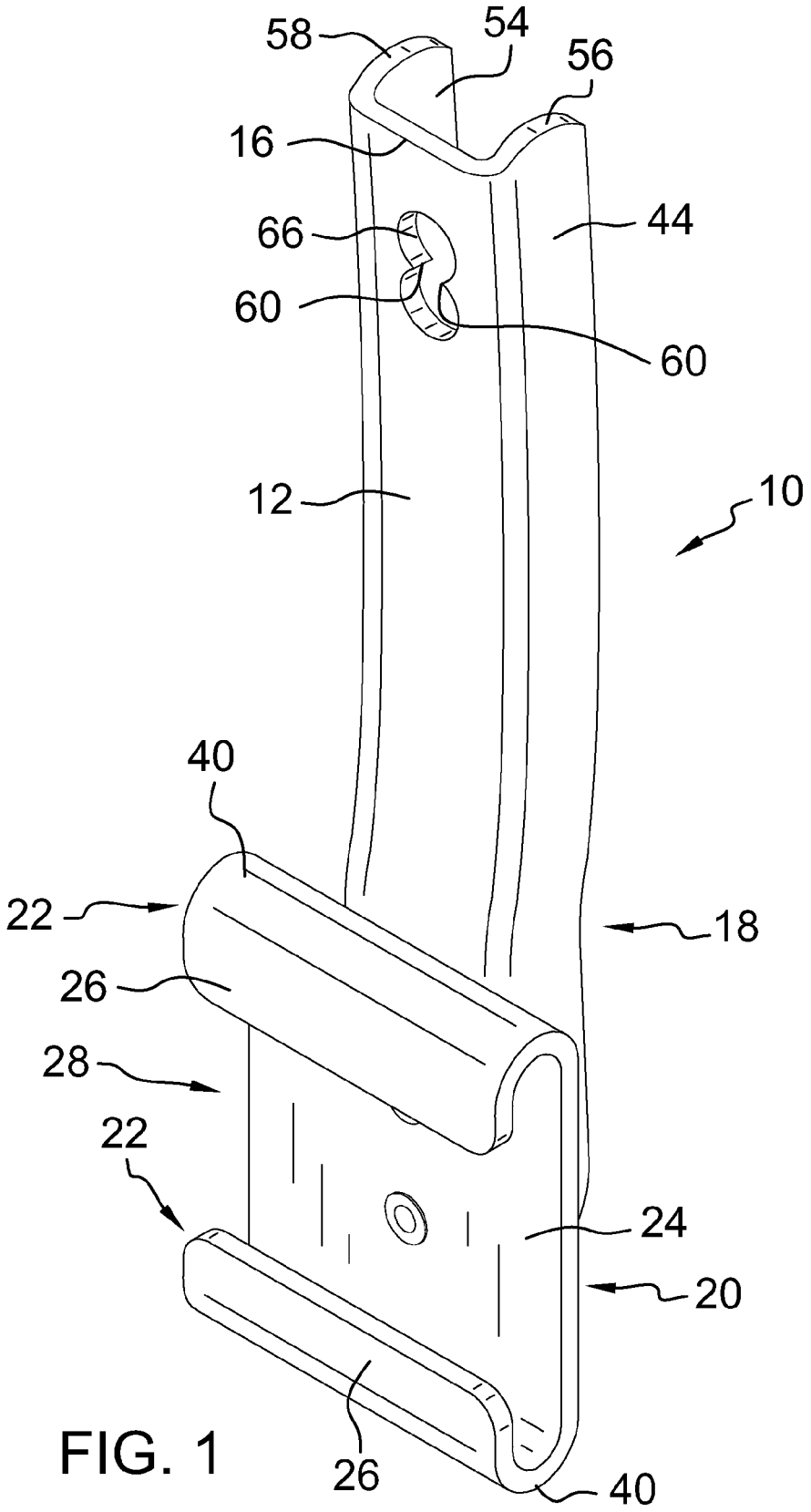
FIG. 1 is a bottom front side perspective view of a container opening device according to an embodiment of the disclosure.
Figure 2:
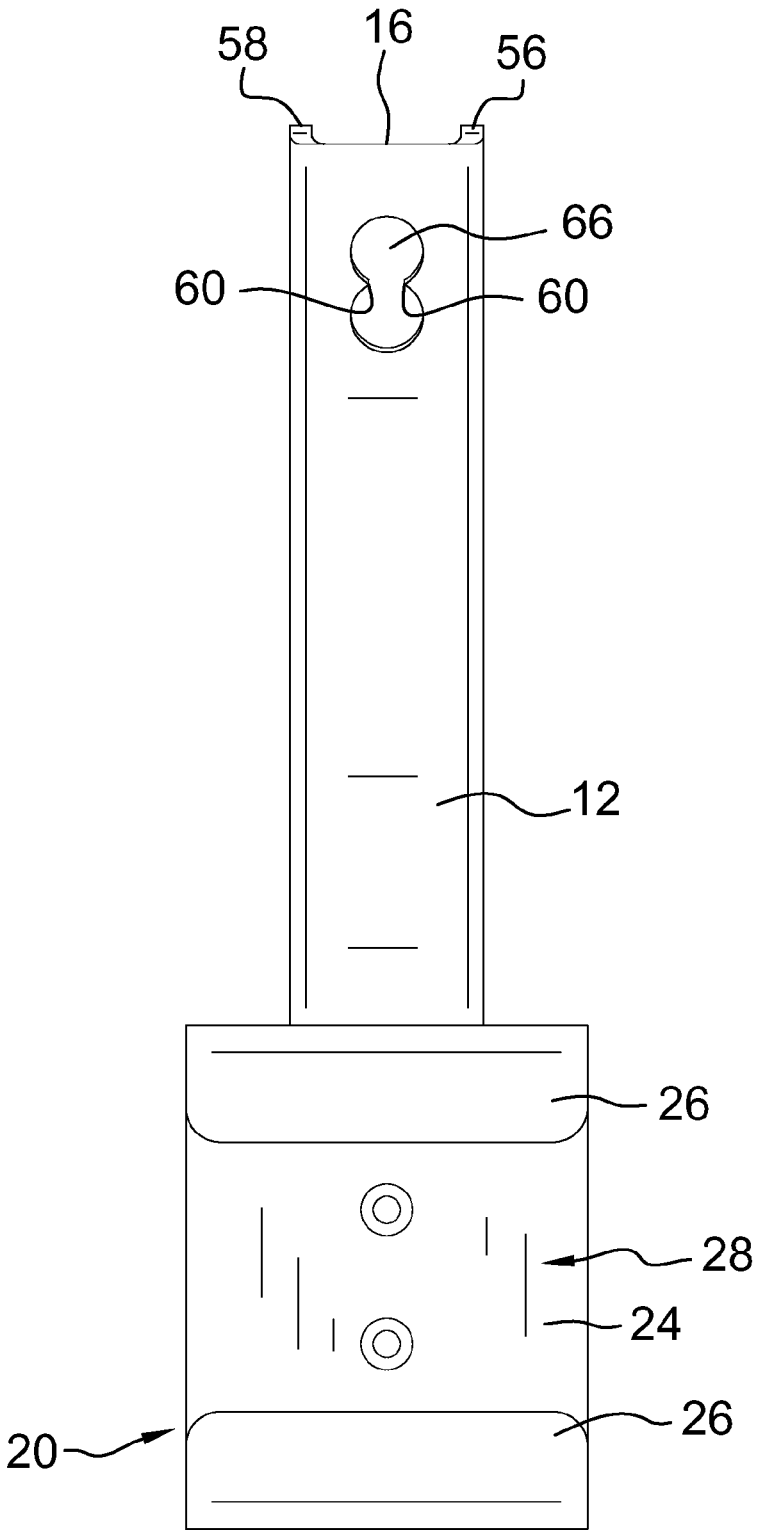
FIG. 2 is a front view of an embodiment of the disclosure.
Figure 3:
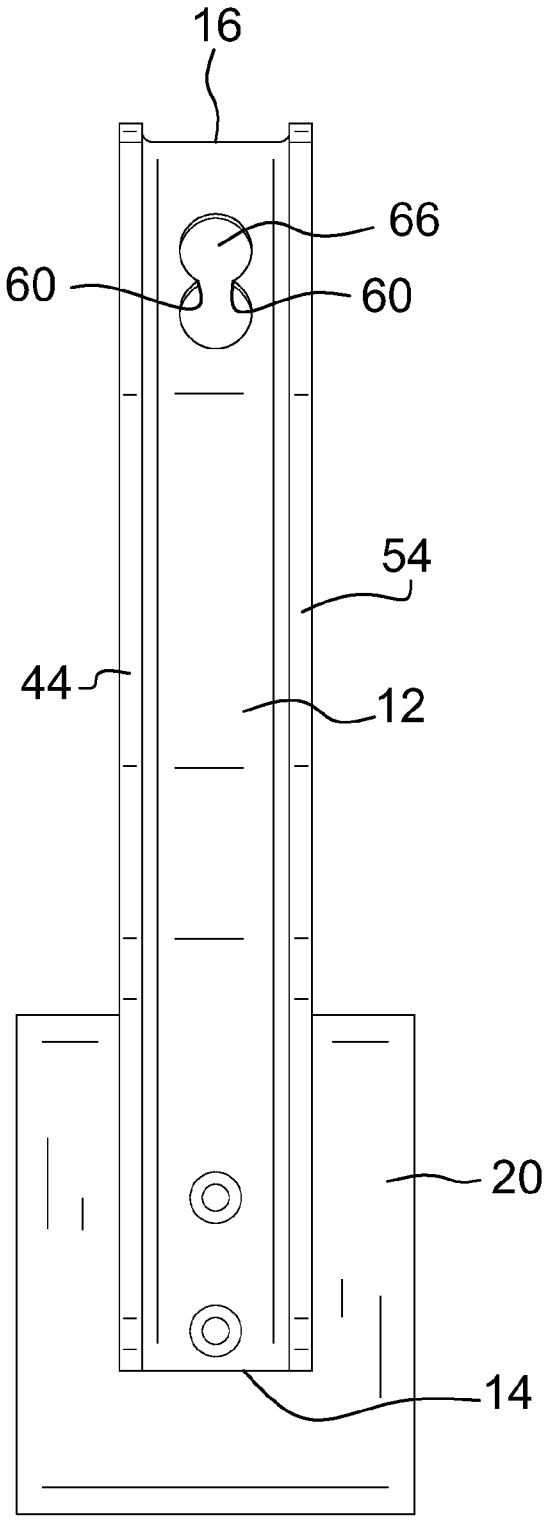
FIG. 3 is a back view of an embodiment of the disclosure.
Figure 4:
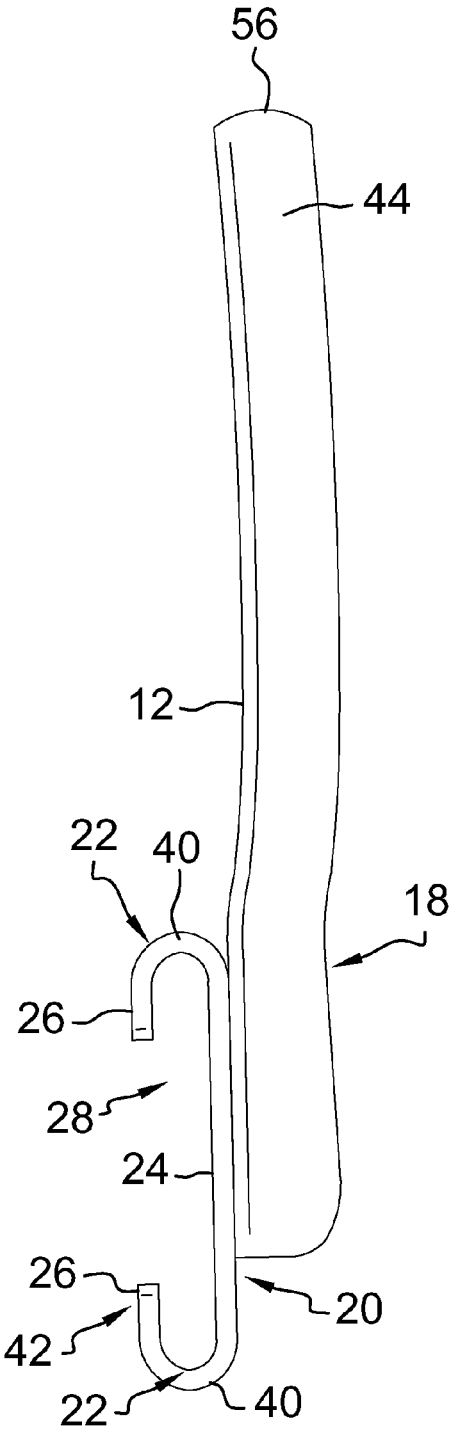
FIG. 4 is a side view of an embodiment of the disclosure.
Figure 5:
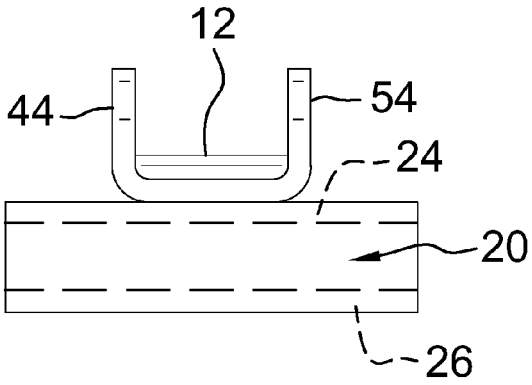
FIG. 5 is a bottom view of an embodiment of the disclosure.
Figure 6:
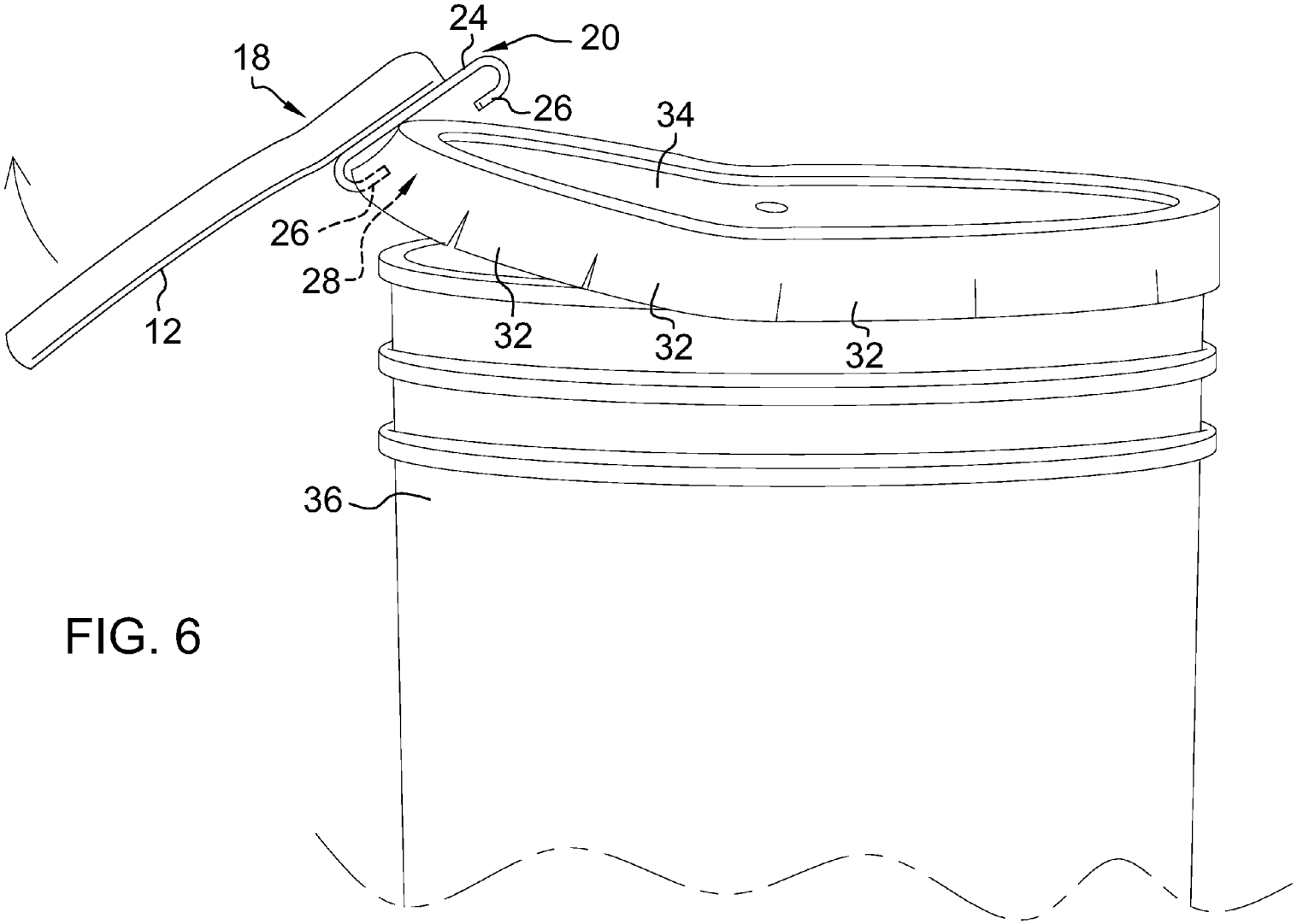
FIG. 6 is a side view of an embodiment of the disclosure in use.
Figure 7:
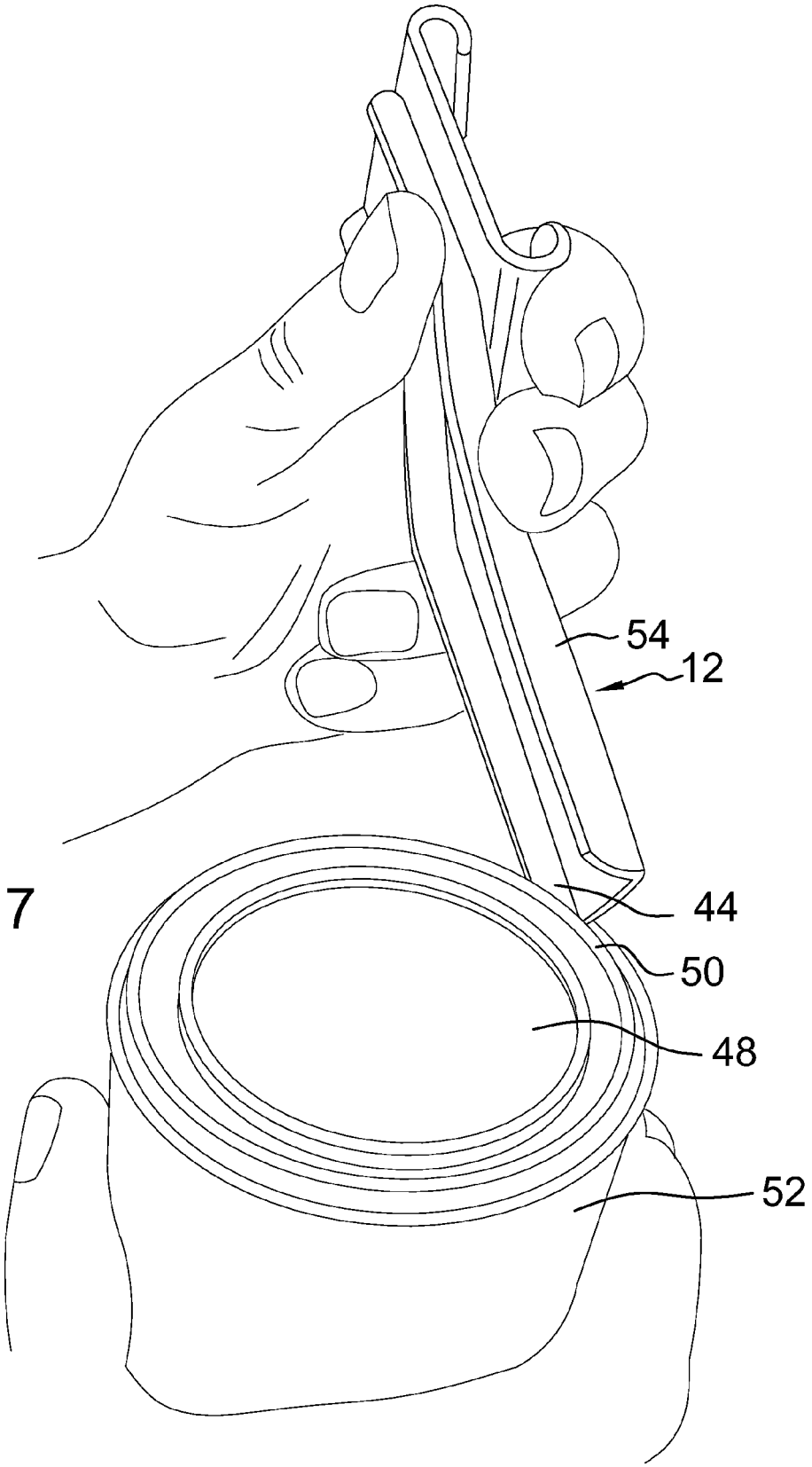
FIG. 7 is a top front side perspective view of an embodiment of the disclosure in use.
Figure 8:
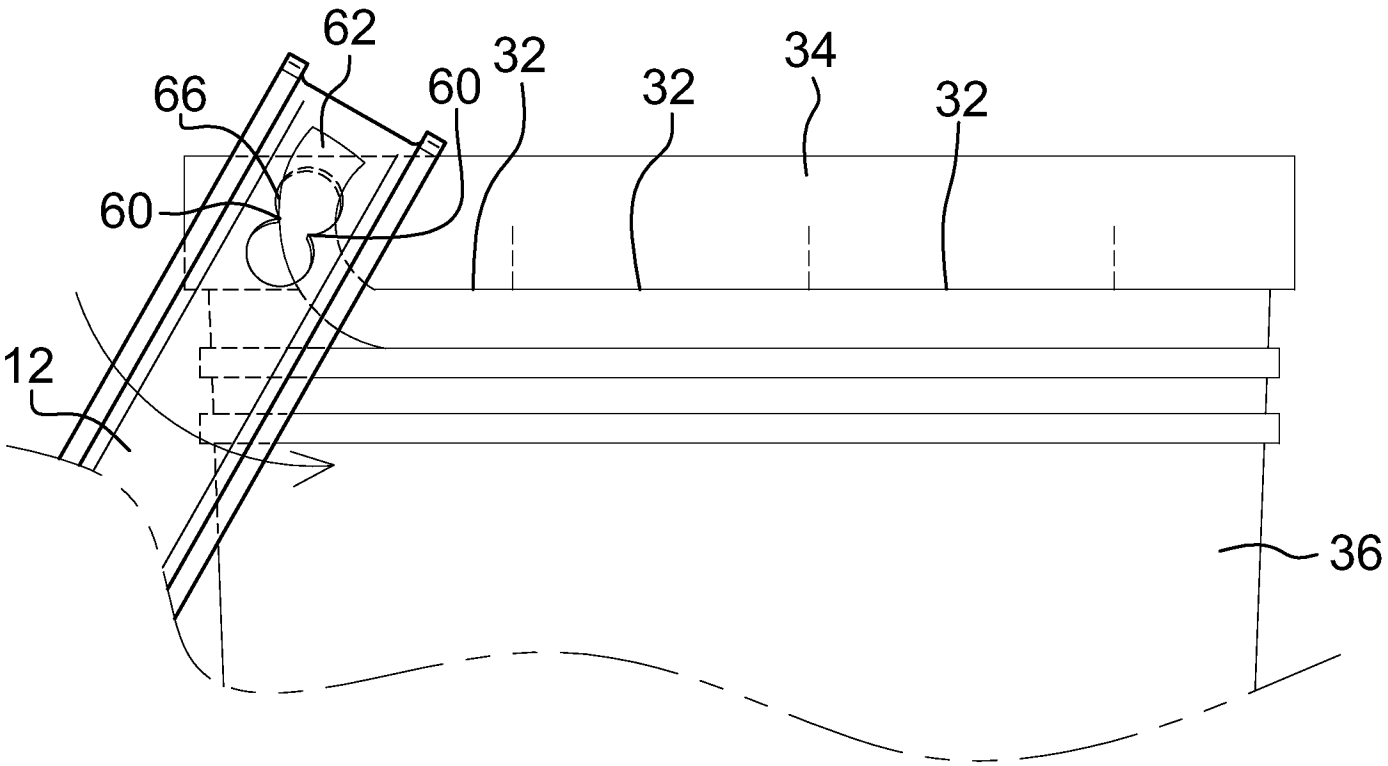
FIG. 8 is a side view of an embodiment of the disclosure in use.

With reference now to the drawings, and in particular to FIGS. 1 through 8 thereof, a new opening device embodying the principles and concepts of an embodiment of the disclosure and generally designated by the reference numeral 10 will be described.

As best illustrated in FIGS. 1 through 8, the container opening device 10 generally comprises a handle 12 having a first end 14 and a second end 16. The handle 12 has a bend 18 positioned between the first end 14 and the second end 16 wherein the first end 14 is offset from the second end 16. A head 20 is coupled to the handle 12. The bend 18 is positioned proximate the head 20. The head 20 has a pair of spaced flanges 22. Each of the flanges 22 is coupled to and extends from a base 24 of the head 20 extending between the flanges 22. Each of the flanges 22 has a planar distal portion 26 positioned in spaced parallel relationship to the base 24. The planar distal portions 26 define a gap 28 therebetween wherein the head 20 is configured for engaging and prying edges 32 of a cover 34 on a bucket 36 to remove the cover 34 from the bucket 36. The head 20 is positioned adjacent the first end 14 of the handle 12. The distal portions 26 of the spaced flanges 22 are coplanar. Each of the flanges 22 has a respective arcuate portion 40 extending between the distal portion 26 and the base 24 wherein the head 20 has a generally C-shaped cross-sectional shape 42.

A first sidewall 44 extends from the handle 12 adjacent to the second end 16 of the handle 12. The first sidewall 44 has a thickness such that the first sidewall 44 is configured for insertion into a space 46 between a lid 48 and a top edge 50 of a can 52 to pry the lid 48 away from the can 52. A second sidewall 54 extends from the handle 12 adjacent to the second end 16 of the handle 12. The second sidewall 54 is used in the same way as the first sidewall 44 but has a thickness different than the thickness of the first sidewall 44. The thicknesses of the first sidewall 44 and second sidewall 54 may be between 7/64 and 9/64 of an inch and between 3/32 and 1/8 of an inch. The second sidewall 54 is positioned in spaced parallel relationship to the first sidewall 44. A respective edge 56,58 of each of the first sidewall 44 and the second sidewall 54 adjacent to the second end 16 of the handle 12 is convexly arcuate relative to the second end 16 of the handle 12. Each of the first sidewall 44 and the second sidewall 54 extends a full length of the handle 12 between the first end 14 and the second end 16.

An aperture 66 extends through the handle 12 defining a pair of opposed barbs 60 oriented transverse to a longitudinal axis of the handle 12. Thus, the aperture 66 is configured for receiving therethrough a strip of material 62 securing the cover 34 to the bucket 36 of the type found on conventional five gallon plastic buckets. The barbs 60 engage the strip of material 62 wherein rotation of the handle 12 facilitates prying of the strip of material 62 away from the cover 34 to permit removal of the cover 34 from the bucket 36.

In use, the head 20, first sidewall 44 and second sidewall 54 may be used to facilitate removal of covers and lids from various types and sizes of containers. The aperture 58 is used as described above to remove the strip of material 62 commonly found securing the lid 34 to the bucket 36 of conventional five gallon buckets.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A container opening device comprising:

a handle having a first end and a second end, said handle having a bend positioned between said first end and said second end wherein said first end is offset from said second end;

a head coupled to said handle, said bend being positioned proximate said head, said head having a pair of spaced flanges, each of said flanges being coupled to and extending from a base of said head extending between said flanges, each of said flanges having a planar distal portion positioned in spaced relationship to said base, said planar distal portions defining a gap therebetween wherein said head is configured for engaging and prying edges of a cover on a bucket to remove the cover from the bucket, said head being positioned adjacent said first end of said handle, said distal portions of said spaced flanges being coplanar, each of said flanges having a respective arcuate portion extending between said distal portion and said base wherein said head has a generally C-shaped cross-sectional shape;

a first sidewall extending from said handle adjacent to said second end of said handle, said first sidewall having a thickness such that said first sidewall is configured for insertion into a space between a lid and a top edge of a can to pry the lid away from the can;

a second sidewall extending from said handle adjacent to said second end of said handle, said second sidewall having a thickness different than said thickness of said first sidewall, said second sidewall being positioned in spaced parallel relationship to said first sidewall, a respective edge of each of said first sidewall and said second sidewall adjacent to said second end of said handle being convexly arcuate relative to said second end of said handle, each of said first sidewall and said second sidewall extending a full length of said handle between said first end and said second end; and an aperture extending through said handle, said aperture defining a pair of opposed barbs wherein said aperture is configured for receiving therethrough a strip of material securing the cover to the bucket such that said barbs engage the strip of material wherein rotation of said handle facilitates prying of the strip of material away from the cover to permit removal of the cover from the bucket.

* * * * *